US006060654A

United States Patent [19]

Valtchev et al.

[11] Patent Number: 6,060,654

[45] Date of Patent: May 9, 2000

[54] ACOUSTICAL APPARATUS SOUND SYSTEM

[75] Inventors: Konstantin L. Valtchev, Don Mills; Harold Gomez, Toronto, both of Canada

[73] Assignee: Valgon Sound Inc., Toronto, Canada

[21] Appl. No.: 09/060,325

[22] Filed: Apr. 15, 1998

Related U.S. Application Data

[63] Continuation-in-part of application No. 08/837,757, Apr. 22, 1997, Pat. No. 5,780,757.

[51] Int. Cl.[7] ..... G10G 7/00

[52] U.S. Cl. ..... 84/453; 84/380 R; 84/382; 84/384; 84/387 R

[58] Field of Search ..... 84/380 R, 382, 84/383 R, 384, 386, 385 R, 387 R, 394, 395, 398, 400, 453

[56] References Cited

U.S. PATENT DOCUMENTS

| | | | |
|---|---|---|---|
| 2,292,584 | 8/1942 | Tafarella | 84/383 |
| 4,428,271 | 1/1984 | Winslow et al. | 84/383 R |
| 5,000,073 | 3/1991 | Hite | 84/383 R |
| 5,440,962 | 8/1995 | Valtchev | 84/383 R |

*Primary Examiner*—Robert E. Nappi
*Assistant Examiner*—Shih-yung Hsieh
*Attorney, Agent, or Firm*—Henderson & Sturm LLP

[57] ABSTRACT

An acoustical ring and bell sound system 10 for use with a variety 101, 102, 103 of musical wind instruments 100; wherein, the sound system comprises an acoustical ring element 21 and an acoustical bell element 31 dimensioned to releasably engage the proximal 104 and distal 105 ends of the musical instrument 100 for producing air turbulence control in the interior of the instrument 100.

25 Claims, 10 Drawing Sheets

ACOUSTICAL APPARATUS SOUND SYSTEM

CROSS-REFERENCE TO RELATED APPLICATIONS

This application is a Continuation-in-Part Application of U.S. Ser. No. 08/837,757, filed Apr. 22, 1997, entitled "Acoustical Ring and Bell Sound System", now U.S. Pat. No. 5,780,757, the disclosure of which is hereby incorporated by reference in its entirety.

STATEMENT REGARDING FEDERALLY SPONSORED RESEARCH OR DEVELOPMENT

Not Applicable.

AUTHORIZATION PURSUANT TO 37 C.F.R §1.71 (d) (e)

A portion of the disclosure of this patent document may contain material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The present invention relates to the field of accessories for musical instruments in general, and in particular to a system for controlling the internal air turbulence in a musical wind instrument.

2. Description of Related Art

The prior art is includes conventional reed ligature construction for maintaining a reed at a desired location on a wind instrument.

While the prior art constructions are more than adequate for the basic purpose and function for which they have been specifically designed, they are uniformly deficient with regard to controlling the air turbulence on the inside of a musical wind instrument.

In the past, the turbulence generated within the musical instrument as a natural by-product of the forced passage of air necessary to generate the musical notes, also made it extremely difficult for the musician to connect the diverse notes evenly in all registers. In addition, the turbulence caused the playing of the various instruments to be more physically stressful and reduced the percentage of reeds that could be effective employed by other than the most skillful musicians.

As a consequence of the foregoing situation, there has existed a longstanding need for a new type of sound system which produces resonance on the exterior of a musical instrument to reduce the turbulence within woodwind and brass instruments bores, and the provision of such a construction is a stated objective of the present invention.

BRIEF SUMMARY OF THE INVENTION

Briefly stated, the acoustical ring and bell sound system that forms the basis of the present invention comprises in general a pair of hollow housing members wherein one of the housing members comprise an acoustical ring element which is normally deployed at the barrel or neck of a musical instrument. The other housing member comprises an acoustic bell element which is normally deployed at the distal end or bell of a musical instrument.

The present invention is directed to an acoustical ring and bell sound system for engagement with distal and proximal ends of a variety of musical wind instruments wherein the sound system comprises: a pair of hollow housing members dimensioned to surround the distal and proximal ends of a musical wind instrument wherein each hollow housing member is provided with a plurality of shoe elements, e.g., as an opposed pair of shoe elements, and preferably at least two shoe elements which are most preferably three in number, which are adapted to engage a selected portion of the periphery of the distal and proximal ends of the musical instrument.

The present invention is also directed to an acoustical ring for selective engagement with the distal and proximal ends of a variety of musical wind instruments wherein the acoustical ring comprises: a generally cylindrical hollow housing member dimensioned to surround one of the ends of a musical wind instrument wherein the hollow housing member is provided with a plurality of shoe elements, e.g., an opposed pair of shoe elements, and preferably at least two shoe elements which are most preferably three in number, which are adapted to engage a selected portion of the periphery of the one end of the musical instrument, wherein each of the shoe elements include an outer handle member, at least one inwardly projecting leg member and an inner contoured shoe member dimensioned to engage a portion of the musical wind instrument and/or wherein each of the shoe elements include pair of inwardly projecting leg members which are dimensioned to be slidably received in suitably dimensioned discrete apertures in the housing members.

The present invention is also directed to an acoustical bell for engagement with the distal end of a variety of musical wind instruments wherein the acoustical bell comprises: a hollow housing member dimensioned to surround the distal end of a musical wind instrument wherein the hollow housing member is provided with an opposed pair of shoe elements which are adapted to engage a selected portion of the periphery of the distal end of the musical instrument, wherein the hollow housing member comprises a generally conical acoustical bell element.

As will be explained in greater detail further on in the specification, each of the housing members are secured on the opposite ends of the musical instrument by a pair of spring biased shoe elements which releasably engage portions of the musical instruments.

The sound system of this invention is a totally new way to create resonance on the outside of the instrument producing a faster control of the air turbulence on the inside of the instrument. This system produces resonance in the air space between the surface of the instrument and the acoustical ring and the acoustical bell. The increased resonance quickly settles the turbulence within the woodwind and brass instrument bore.

This results in notes being connected evenly in all registers. The additional source of resonance permits better projection of the sound with less physical stress. A better focused and more even tone is produced with considerably less effort. The disruption of tone in critical places such as over the breaks will now be smooth as turbulence in the bore of the instrument is quickly adjusted to connect each note of the scale in a legato and centered way.

The results are so profound that the conductor, adjudicator, teacher and even family members will immediately hear the improvement in someone's playing. The acoustical system of this invention can also be used with both woodwind and brass instruments.

BRIEF DESCRIPTION OF THE SEVERAL VIEW OF THE DRAWING

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1A:
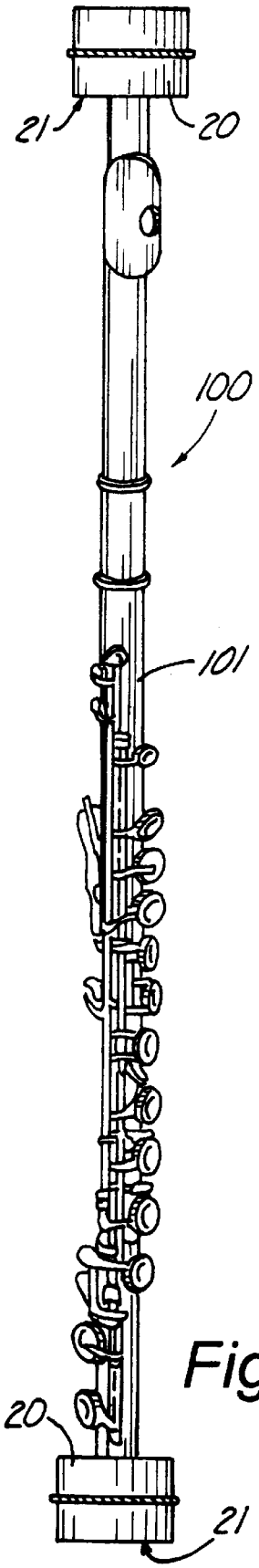
FIG. 1 is a perspective view of the acoustical ring and bell sound system that forms the basis of the present invention installed on a variety of musical wind instruments.
Figure 1B:
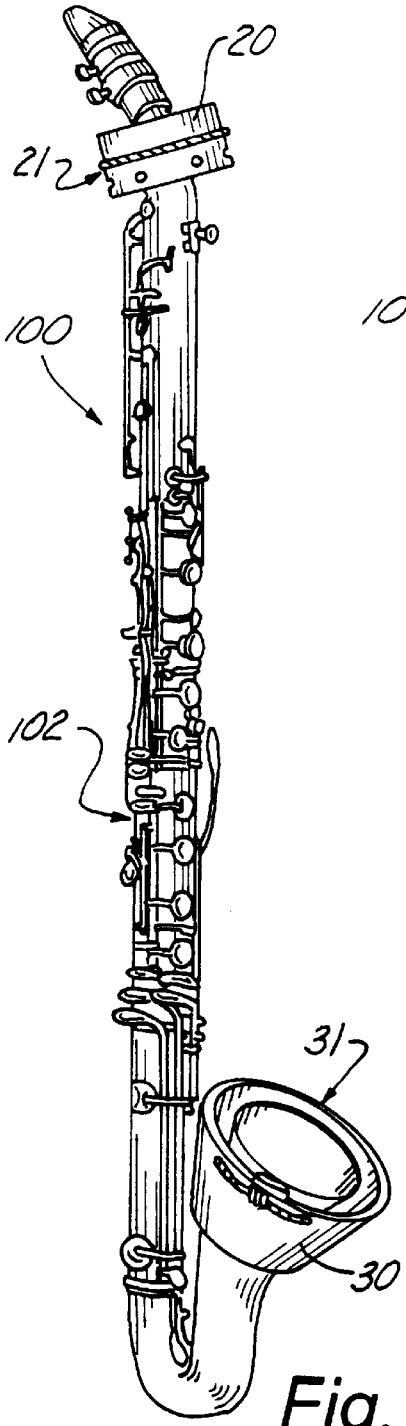
Figure 1C:
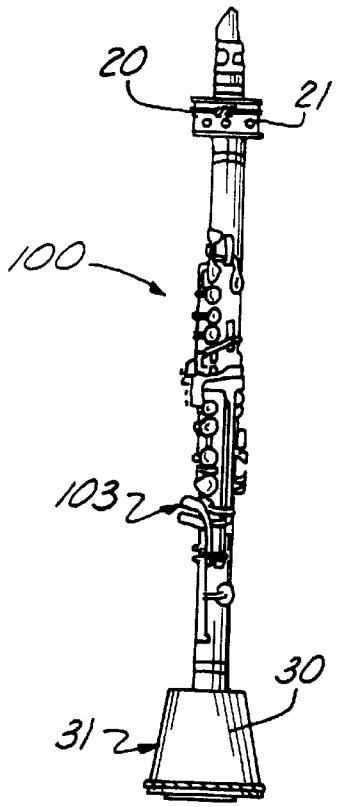

As can be seen by reference to the drawings, and in particularly to FIG. 1, the acoustical ring and bell sound system that forms the basis of the present invention is designated generally by the reference number 10. The sound system comprises in general a pair of housing members 20 and 30 which are adapted to releasably engage the opposite ends of a variety of musical instruments such as flute 101, alto clarinet 102, b-flat clarinet 103, or other woodwind or brass musical instrument, including but not limited to, piccolos, saxophones, etc.

The present invention is directed to an acoustical ring and bell sound system for engagement with distal and proximal ends of a variety of musical wind instruments wherein the sound system comprises: a pair of hollow housing members dimensioned to surround the distal and proximal ends of a musical wind instrument wherein each hollow housing member is provided with a plurality of shoe elements, e.g., as an opposed pair of shoe elements, and preferably at least two shoe elements which are most preferably three in number which are adapted to engage a selected portion of the periphery of the distal and proximal ends of the musical instrument.

The present invention is also directed to an acoustical ring for selective engagement with the distal and proximal ends of a variety of musical wind instruments wherein the acoustical ring comprises: a generally cylindrical hollow housing member dimensioned to surround one of the ends of a musical wind instrument wherein the hollow housing member is provided with a plurality of shoe elements, e.g., an opposed pair of shoe elements, and preferably at least two shoe elements which are most preferably three in number which are adapted to engage a selected portion of the periphery of the one end of the musical instrument, wherein each of the shoe elements include an outer handle member, at least one inwardly projecting leg member and an inner contoured shoe member dimensioned to engage a portion of the musical wind instrument and/or wherein each of the shoe elements include pair of inwardly projecting leg members which are dimensioned to be slidably received in suitably dimensioned discrete apertures in the housing members.

The present invention is also directed to an acoustical bell for engagement with the distal end of a variety of musical wind instruments wherein the acoustical bell comprises: a hollow housing member dimensioned to surround the distal end of a musical wind instrument wherein the hollow housing member is provided with an opposed pair of shoe elements which are adapted to engage a selected portion of the periphery of the distal end of the musical instrument, wherein the hollow housing member comprises a generally conical acoustical bell element.

In accordance with the present invention, at least one of the hollow housing members comprises an acoustical ring element, at least one of the hollow housing members comprises an acoustical bell element comprising a shape selected from the group consisting of a generally cylindrical shaped element, and a generally conical shaped element, or both of the hollow housing members comprise an acoustical ring element comprising a shape selected from the group consisting of a generally cylindrical shaped element, and a generally conical shaped element.

For purposes of the present invention, each of the shoe elements includes an outer handle member, at least one inwardly projecting leg member, and an inner contoured shoe member dimensioned to engage a portion of the musical wind instrument, in addition to a pair of inwardly projecting leg members which are dimensioned to be slidably received in suitably dimensioned discrete apertures in the housing members.

In accordance with the sound system of the present invention, at least one of the hollow members is provided with a plurality of shoe elements which are adapted to engage a selected portion of the periphery of the distal end and proximal ends of the musical instrument.

The plurality of shoe elements are shown in the drawings as an opposed pair of shoe elements, although at least two, or more, shoe elements, for example three shoe elements, are preferred.

In the sound system of the present invention, at least one of the housing members is provided with a plurality of apertures, is provided with means to selectively cover the plurality of apertures.

In the sound system of the present invention, the distal and proximal ends of at least one of the housing members are provided with reinforced lips.

For purposes of the present invention, the at least one of the housing members is a rigid continuous member, or is a flexible split member.

In the sound system of the present invention, each of the shoe elements are biased inwardly by a single spring element, or are biased inwardly by independent spring elements.

In accordance with the present invention, the ring element has a generally uniform interior configuration, for example, in the case of a generally cylindrical shaped element, and/or the conical acoustical bell element has an interior configuration provided with a notch dimensioned to receive an outwardly projecting portion of a musical wind instrument.

For purposes of the present invention, the hollow housing members has an opening formed in the distal end and the proximal end, wherein, the distal end opening and the proximal end opening are aligned generally parallel to one another, and/or at least one of the housing members has a distal end opening that is larger than the proximal end opening, wherein, the distal end opening and the proximal end opening of the at least one housing member are aligned generally parallel to one another, and/or wherein the distal end opening and the proximal end opening of the at least one housing member are disposed at an angle relative to one another.

In accordance with the present invention, the proximal end of the housing member is provided with opposed pairs of guide tubes dimensioned to receive portions of the shoe elements, wherein each of the shoe elements are provided with a pair of spring biasing elements, spring biasing elements are disposed on the interior of the housing member.

For purposes of the present invention, housing member is fabricated form a semi-rigid, resilient material, each of the shoe elements include an inwardly extending leg member and a contoured shoe member, and are formed integrally with the interior of the housing, or are permanently affixed to the interior of the housing.

Referring more specifically to the drawings, the housing members 20 and 30 will now be described in seriatim fashion.

As shown in FIGS. 2 through 5, the first housing member 20 comprises a generally cylindrical acoustical ring element 22 wherein the distal and proximal ends of the ring element 22 are provided with reinforced lips 23 and the intermediate periphery of the ring element 22 may optionally be provided with a plurality of apertures 24 whose purpose and function will be described in greater detail further on in the specification.

Figure 2:
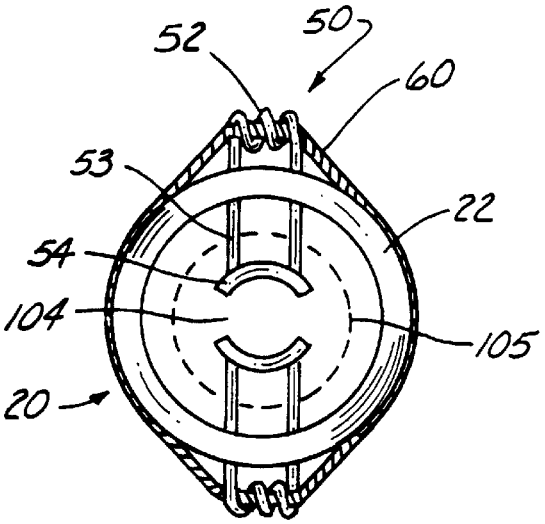
FIG. 2 is an end view of an acoustical ring grasping an instrument having a narrow neck.
Figure 3:
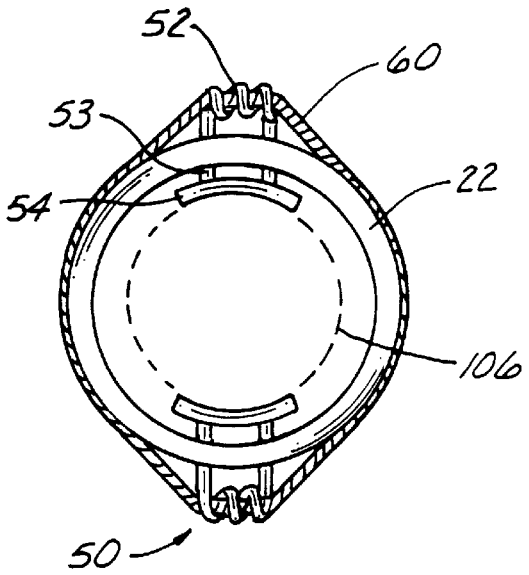
FIG. 3 is an end view of an acoustical ring grasping an instrument having an enlarged neck.
Figure 4:
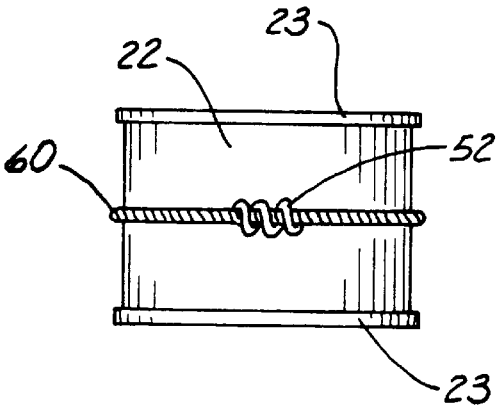
FIG. 4 is a top plan view of the exterior of one acoustical ring configuration.
Figure 5:
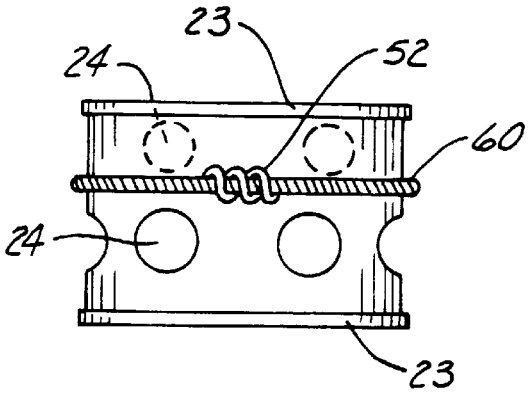
FIG. 5 is a top plan view of the exterior of another acoustical ring configuration.

In addition, as depicted in FIGS. 2 and 3, the interior of the acoustical ring element 22 is dimensioned to receive the barrel 104 or neck 105 portions of a musical instrument 100.

Figure 6:
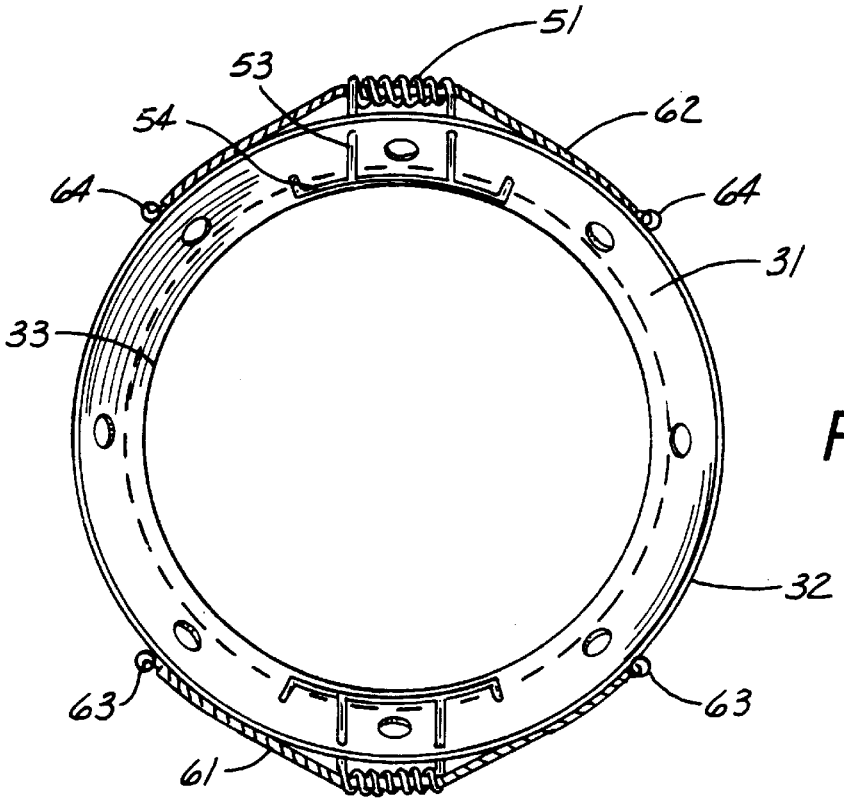
FIG. 6 is an end view of an enlarged apertured acoustical bell.
Figure 7:
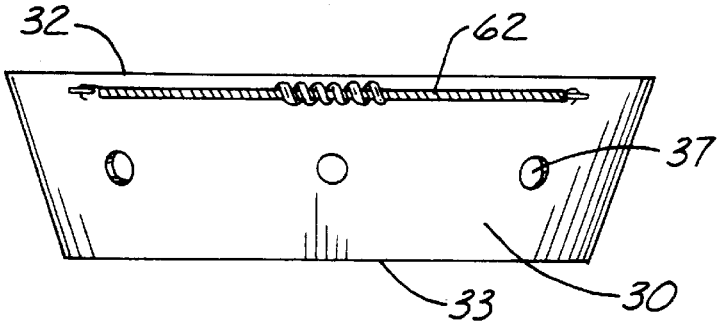
FIG. 7 is a top plan view of the apertured acoustical bell of FIG. 6.
Figure 11:
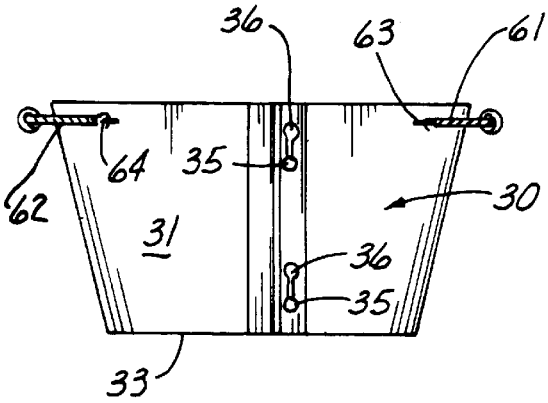
FIG. 11 is a top plan view of the split ring version of FIG. 9.
Figure 12:
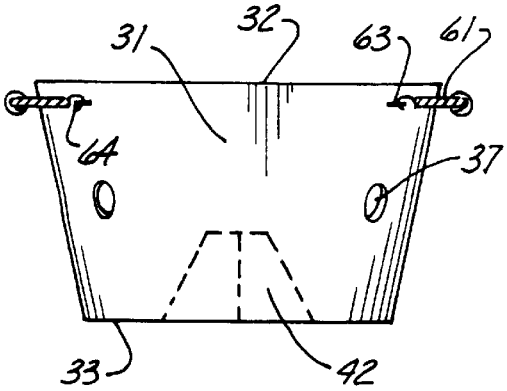
FIG. 12 is a bottom plan view of the split and notched version of FIG. 10.
Figure 13:
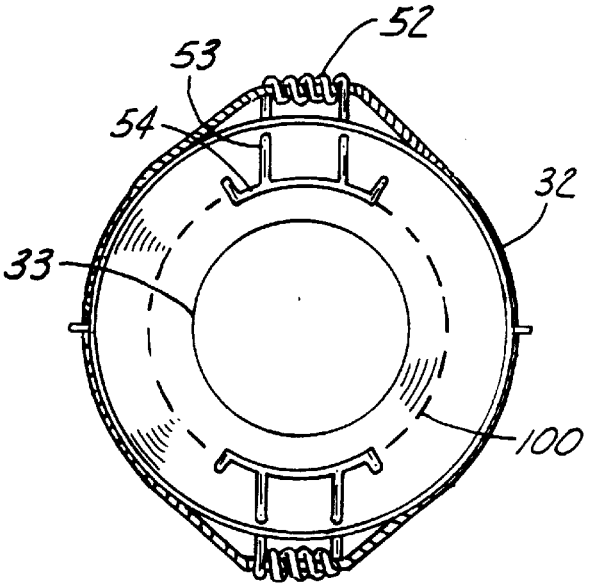
FIG. 13 is an end view of the smaller one-piece version of the acoustical bell.

Turning now to FIGS. 6 through 14, it can be seen that the second housing member 30 comprises a generally conical acoustical bell element 31 having an enlarged diameter distal end 32 and a reduced diameter proximal end 33. As shown in FIGS. 6, 9, 10, and 13, the acoustical bell element 31 is manufactured in different sizes so that the reduced diameter proximal end can slip over the distal end of a variety of musical instruments 100. Furthermore, the acoustical bell element 31 may be fabricated as a generally rigid smooth continuous member as depicted in FIGS. 6 and 13. Element 31 may be split as at 34 in FIGS. 9 through 11 to impart some flexibility to the bell element 31, and can slip over the distal end of a variety of musical instruments in open positions.

Figure 9:
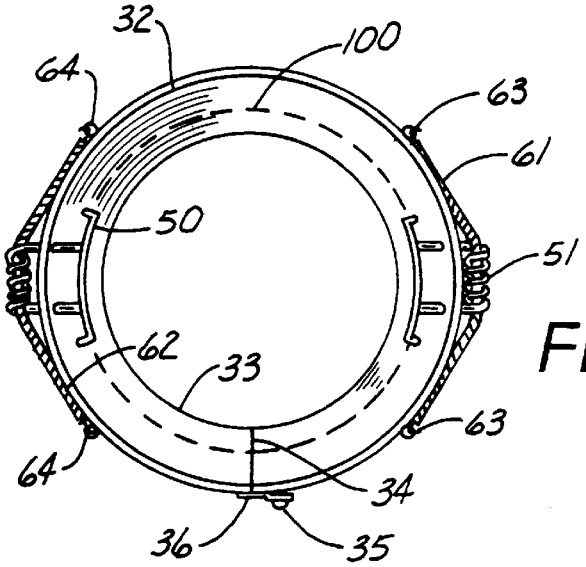
FIG. 9 is an end view of the split ring version of the acoustical bell.
Figure 10:
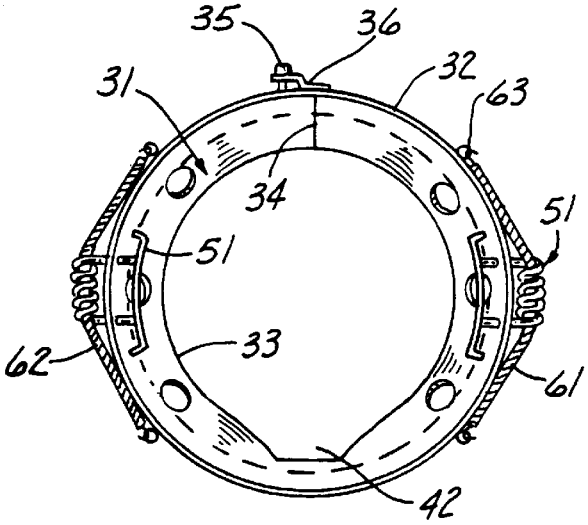
FIG. 10 is an end view of the split and notched version of the acoustical bell.

As can best be seen by reference to FIGS. 9 through 11, in the split ring version of the acoustical bell element 31 the opposed ends of the bell element 31 are provided with a post 35 and catch 36 assembly which joins the opposed ends of the split ring version of the bell element 31 in a well recognized fashion.

Figure 22A:
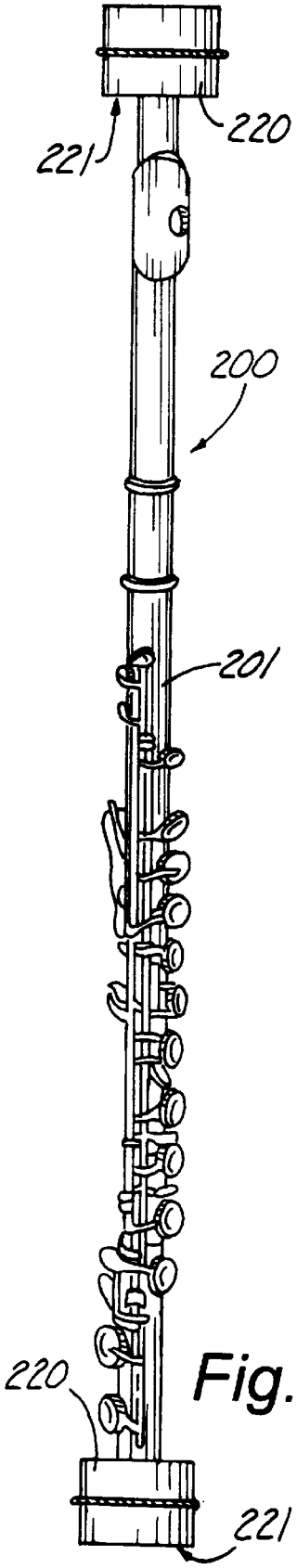
FIG. 22 is a perspective view of the acoustical ring and bell sound system provided with a cylindrical bell.
Figure 22B:
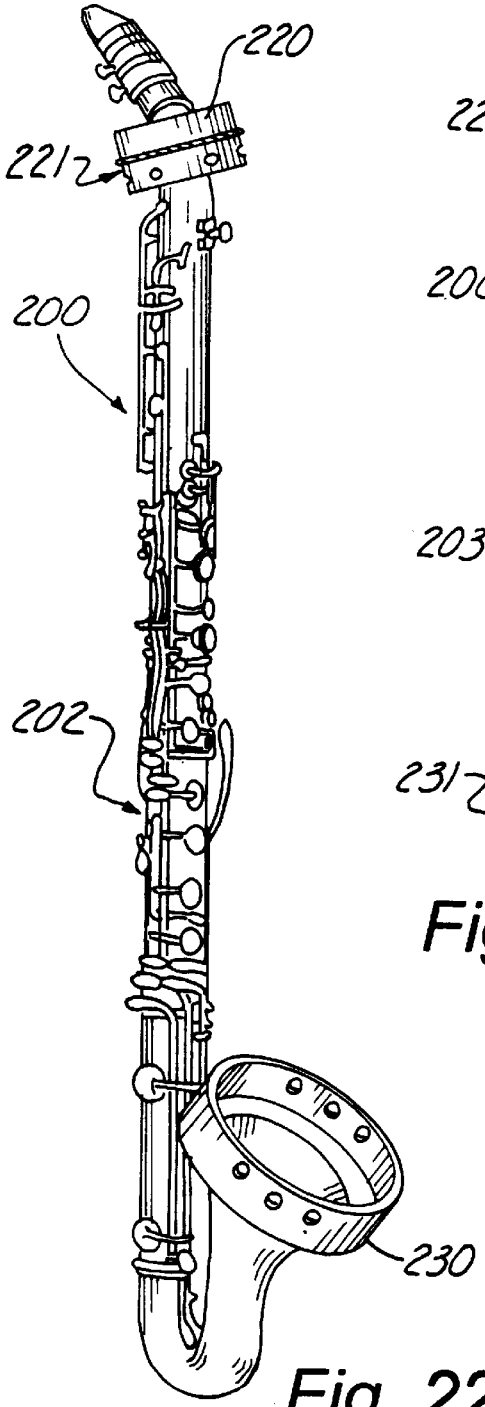
Figure 22C:
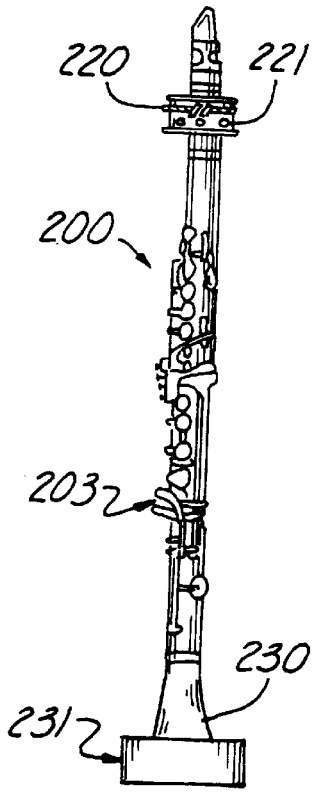

The acoustic bell element may be formed into a variety of different shapes, but preferably has a shape selected from the group consisting of a generally conical shape and a generally cylindrical shape, as shown in FIG. 1 and FIG. 22, respectively, as 31 and 231.

Figure 8:
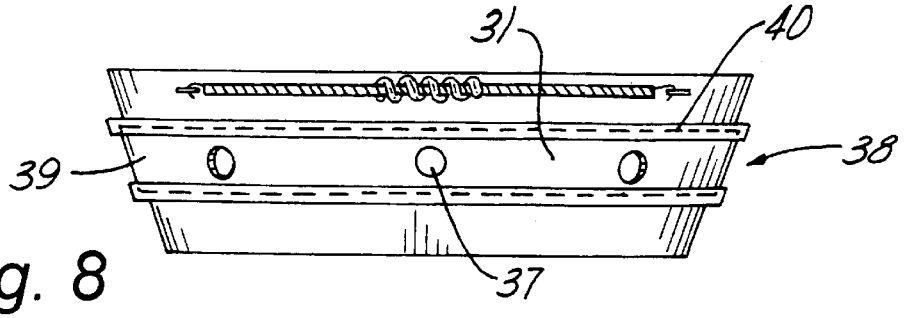
FIG. 8 is a top plan view of a modified version of the acoustical bell depicted in FIG. 6.

In addition, as shown in FIGS. 6 through 8, and 12, the second housing member 30 may likewise be provided with a plurality of apertures 37. As shown in particular in FIG. 8, an aperture control member 38 may be installed on the outer periphery of the acoustical bell element 31 to selectively cover the apertures 37 to achieve different tones to the musical notes. In the embodiment of FIG. 8, the aperture control member 38 comprises a belt 39 and groove 40 arrangement. However, other aperture control arrangements may be substituted therefor.

At this junction, it should be apparent that both the acoustical ring element 21 and the acoustical bell element 31 share a number of structural similarities Those similarities also extend to the releasable securing means 50 that are employed for operatively engaging the two housing members 20 and 30 to the opposite ends of the musical instruments 100.

In accordance with the sound system of the present invention, at least one of the hollow members is provided with a plurality of shoe elements which are adapted to engage a selected portion of the periphery of the distal end and proximal ends of the musical instrument.

Figure 23A:
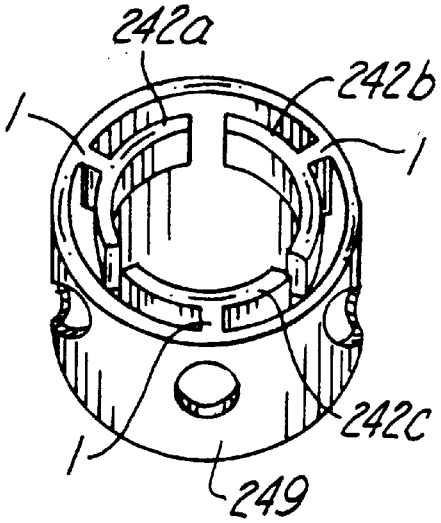
FIG. 23 is a view of a proximal ring.

The plurality of shoe elements are shown in the drawings as an opposed pair of shoe elements, although at least two, or more, shoe elements, for example three shoe elements, are preferred, the latter being shown in FIG. 23A.

As shown in FIGS. 2, 3, 9, 10 and 16, the releasable securing means 50 comprises a plurality of opposed spring biased shoe elements 51, which are preferably two, or more, in number and, as shown in FIG. 23A are three in number. Each of the shoe elements 51 include an outwardly projecting handle member 52, a pair of inwardly extending leg members 53 which pass through suitably dimensioned discrete apertures (not shown) in the respective housing members 20 and 30, and an inner contoured shoe member 54 dimensioned to receive a portion of the periphery of the musical instruments 100.

Figure 15:
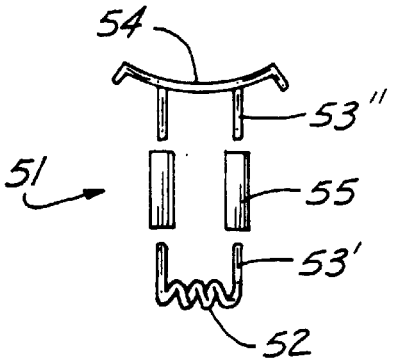
FIG. 15 is an exploded perspective view of the multi-piece shoe of this invention.
Figure 16:
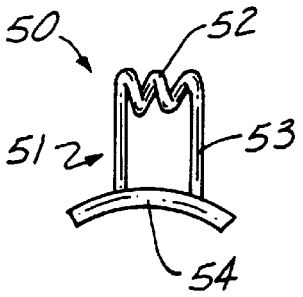
FIG. 16 is a front plan view of the one-piece shoe.
Figure 14:
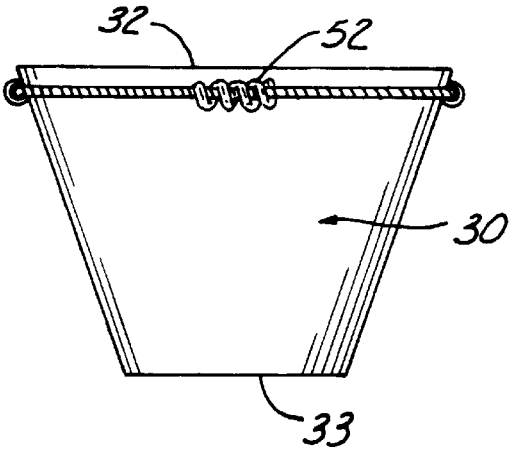
FIG. 14 is a top plan view of the one-piece version.
Figure 17:
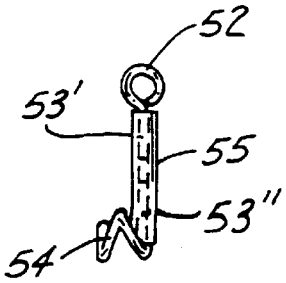
FIG. 17 is a side plan view of the multi-piece shoe.

In an alternate version of the invention depicted in FIGS. 15 and 17, each of the shoe elements 51 have upper 53' and lower 53" leg segments which are connected to one another by a tubular coupler 55 which extends the effective length of the shoe element 51.

As shown in FIGS. 2, 3, 9, and 10, depending on the size of the respective housing members 20 and 30, the shoe elements 51 may be operatively connected to the housing members 20, 30 by a single elongated spring member 60 or by a corresponding number, such as a pair, of independently acting spring members 61, 62 which are operatively connected to the outer periphery of the housing members 20,30 by a corresponding number, such as two pairs, of post elements 63, 63 and 64, 64.

Turning now to FIGS. 10 and 12, it can be seen that while inmost instances the interior of the acoustical ring elements 31 will have a uniform configuration, there will be certain instances wherein a contoured notch 42 will have to be provided in the proximal end 33 of the acoustical bell element 31 to accommodate a given protrusion, such as the bar that connects the bell to the body of the saxophone (not shown).

Returning once more to FIG. 1, it can be seen that while in most instances the housing members 20 and 30 are disposed on opposite ends of the musical instrument 100, in the case of the flute 101, the first housing member 20 comprising the acoustical ring element 21 is disposed on the opposite ends of the flute 101.

Figure 18:
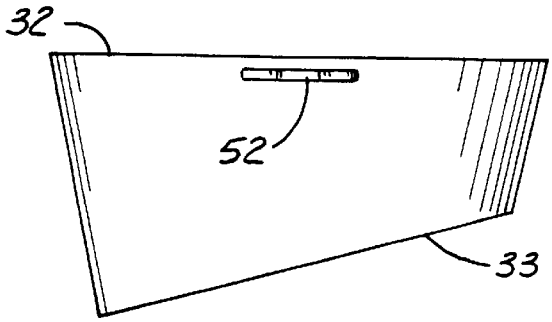
FIG. 18 is a top plan view of an alternate version of the acoustical bell.
Figure 19:
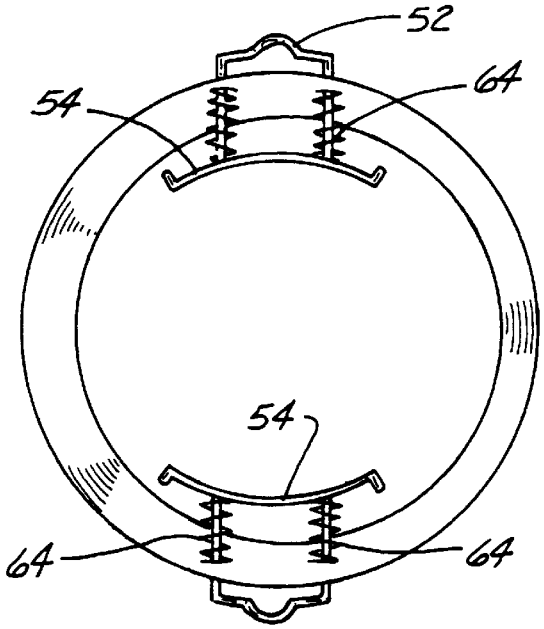
FIG. 19 is a front plan view of the alternate version of the acoustical bell.
Figure 20:
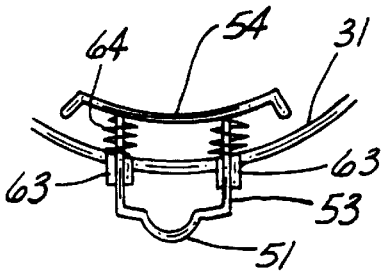
FIG. 20 is a cross sectional view taken through line 20–20 of FIG. 19.

In another alternate version of the preferred embodiment illustrated in FIGS. 18 through 20, it can be seen that there are certain instances wherein the shape of the acoustical bell 30 must be contoured in order to accommodate the curvature of the bell of a particular instrument 100 such as a saxophone or the like (not shown). In the embodiment depicted in FIGS. 18 and 19, it can be seen that the reduced diameter proximal end 33 is angularly disposed relative to the enlarged diameter distal end 33 of the acoustical bell 30 to accomplish that objective. Accordingly, in such an embodiment, the acoustic bell element is a generally conical shaped element.

From the standpoint of performance, however, a generally cylindrical shaped element is preferred. This is particularly preferred from the standpoint of acoustical performance. Referring to FIG. 22 with respect to the acoustic bell element of the present invention, the acoustic bell element is shown as a generally cylindrical shaped element 231 and 236 which structurally corresponds substantially to the generally conical shaped element 31 and 36 in FIG. 1 on the flute and saxophone, respectively. As previously indicated, however, from the acoustical performance standpoint, the generally cylindrically shaped element is preferred.

Still referring to FIGS. 18 through 20, it can be seen that in this particular version of the preferred embodiment, the reduced diameter proximal end 32 is provided with opposed pairs of guide tubes 63 which are dimensioned to receive the inwardly extending leg members 53 of the spring biased shoe elements 51; wherein each of the leg members 53 is provided with individual spring biasing elements 64. In addition, the spring biasing elements 64 are disposed intermediate the contoured shoe member 54 and the interior of the proximal end 32 of the acoustical bell element 31.

Figure 21:
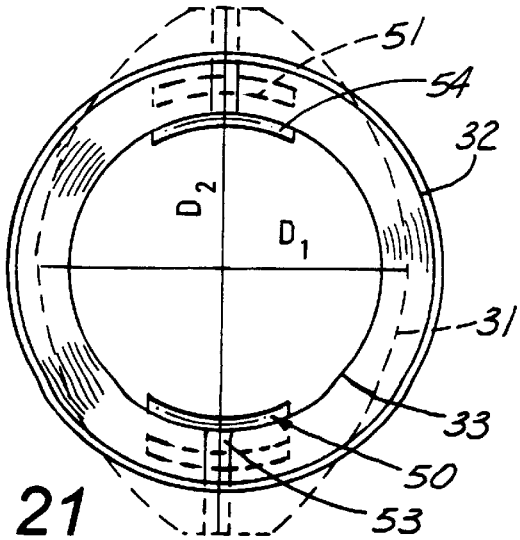
FIG. 21 is a front plan view of yet another alternate version of the acoustical bell.

In yet another alternate version of the invention depicted in FIG. 21, an essentially one-piece construction is illustrated. In this embodiment, the ring may be substantially cylindrical in shape or substantially conical in shape. Referring to FIG. 21, it can be seen that the acoustical bell element 31 is fabricated from a semi-rigid yet resilient thin walled material 38, such as plastic or the like, wherein, the opposite sidewalls of the bell element 31 may be deformed to change the configuration of the proximal end 32 of the bell element 31 from generally circular to generally elliptical configuration. For example, when the ring is squeezed at line D1, the shape becomes elliptical. This releases the grip on the bell.

In addition, in this version of the invention, the releasable securing means 50 comprises a pair of shoe elements 51 formed integrally with, or permanently affixed to, the interior walls of the bell element 31 in a diametrically opposed fashion.

Furthermore, each of the shoe elements 51 comprise a single elongated leg member 53 which projects inwardly from the interior of the bell element 31 and an arcuate contoured shoe member 54 which extends outwardly from both sides of the leg member 53.

As can also be seen by reference to FIG. 21, the forcible deformation of the sidewalls of the bell element 31 will raise and lower the shoe elements 51 into and out of engagement with the periphery of a musical instrument.

Figure 26A:
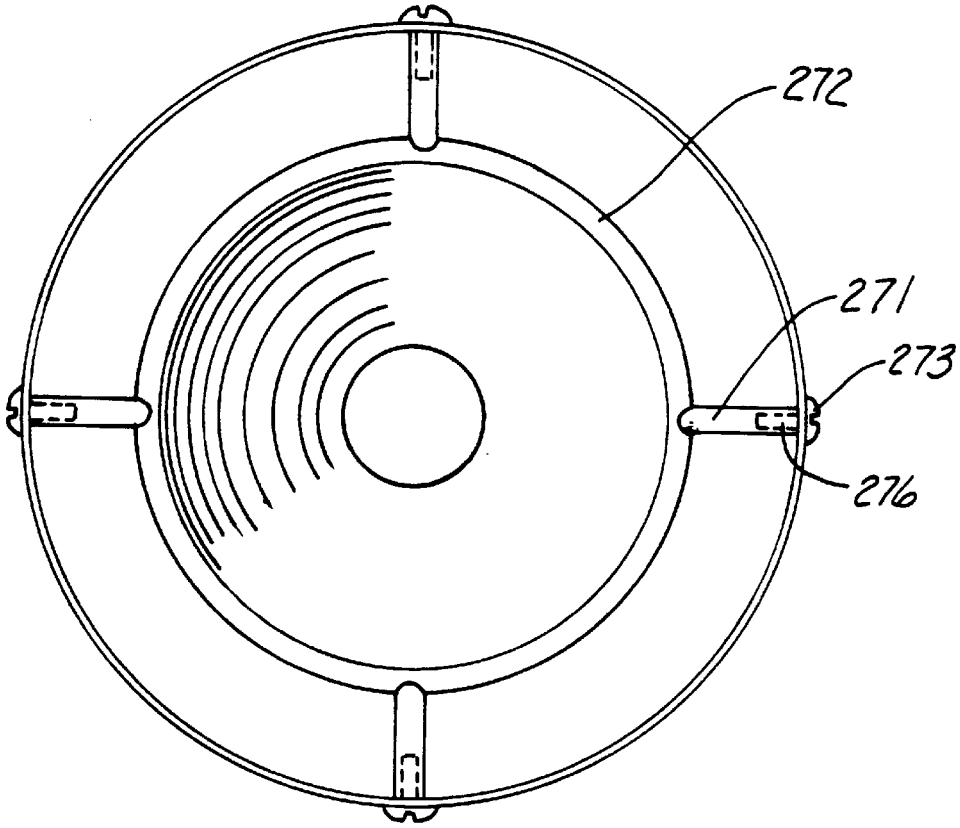
FIG. 26 is a view of a permanent attachment of apparatus of the present invention.
Figure 26B:
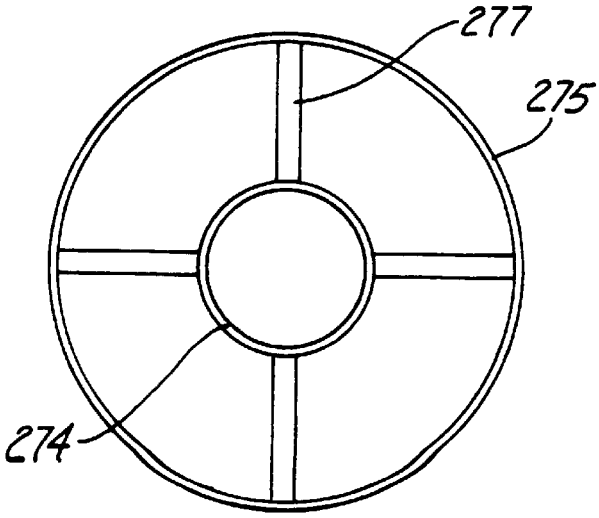

It should further be appreciated at this juncture that this invention also contemplates that both the acoustical ring and bell constructions described herein may be permanently attached to the various instruments at the time that the instruments are manufactured. Such permanent attachment may be effected using conventional procedures, such as soldering, welding, and/or application of adhesive, as are used in the industry of manufacturing musical instruments. The musical instruments to which the acoustic ring and/or acoustic bell of the present invention are permanently attached, however, do not necessarily appear differently from the conventional musical instruments to which the acoustic ring and/or acoustic bell of the present invention have been attached as an after market attachment, as otherwise shown in the drawings. An example of such permanent attachment is shown in FIG. 26.

In this example, referring to FIG. 21A, one end of a rod 271 is permanently attached, for example by welding, to a metal ring 272 of a musical instrument and an opposite of the rod 273 is attached by means for attachment 276, such as screws 276, to the bell ring. Alternatively, glue or other adhesive means for attachment 276. Referring to FIG. 21B, the rods 277 are welded to the neck of the instrument 274 and to the metal ring 275.

Figure 23B:
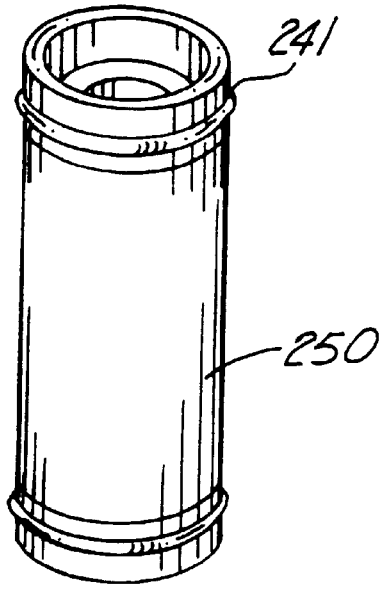
Figure 23C:
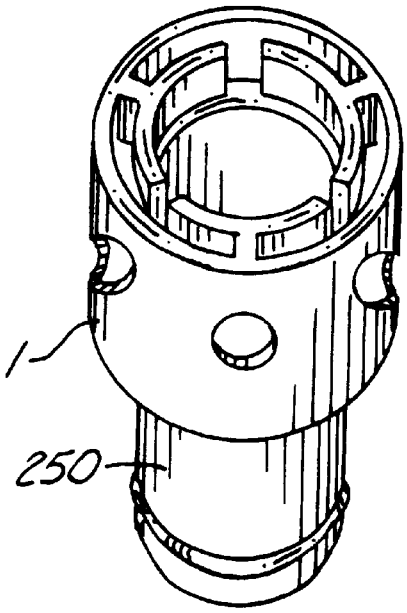

FIG. 23 illustrates means for attaching a proximal acoustic ring 1 to a musical instrument, the musical instrument to which the proximal acoustical ring 1 is preferably a clarinet (not shown). To attach this proximal acoustical ring, the existing proximal metal ring 241 of the clarinet barrel 250 must be removed. In its place the proximal acoustical ring 249 is inserted in such a way that the shoe elements 242 fit in the place of removed metal ring. The proximal acoustical ring 1 is shown in place in FIG. 23C.

Figure 24:
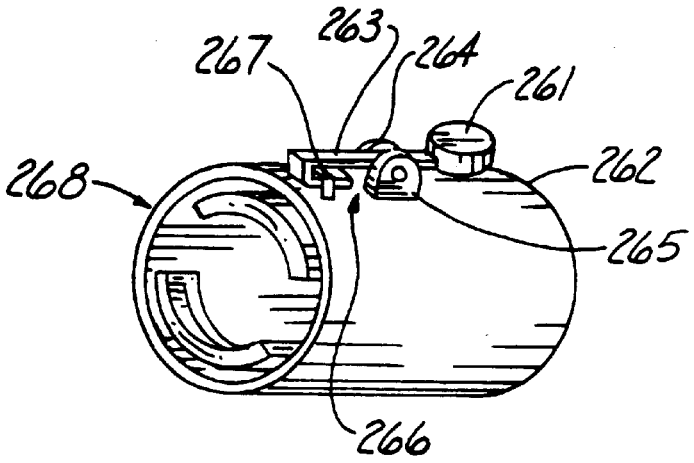
FIG. 24 is a view of the lifting mechanism of the present invention.

FIG. 24 illustrates a novel lifting mechanism for the shoe for at least some of the acoustical rings. The outside portion of the shoe element 267 is inserted in the slot 266 of the rod 260. A key like element 261 is attached to the opposite end of the rod 263. The rod 263 is rotating around the pin 264 going through the posts 265. The posts are attached permanently to the acoustical ring 268. A tension spring 262 is housed under the key 261 exerting upwards pressure on the key 261. This results in moving the opposite end of the rod 263 downward toward the cavity of the acoustical ring pushing the outside portion of the shoe toward the instrument to which the ring has to be attached. There is a similar mechanism on the opposite side of the acoustical ring (not shown) and they work as a pair holding the instrument.

Figure 25A:
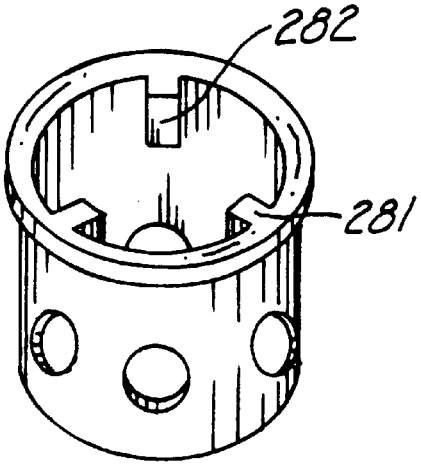
FIG. 25 is another view of a proximal ring.
Figure 25B:
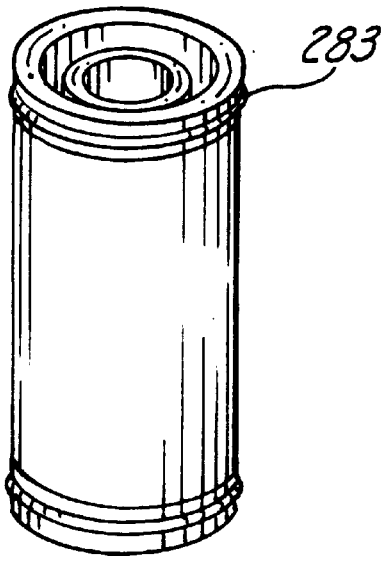

FIG. 25 illustrates another embodiment of the present invention for attaching a proximal ring of the present invention over an existing proximal metal ring of a barrel of a musical instrument, such as a clarinet. Referring to FIG. 25, the proximal ring has a plurality of inward extensions 281, which are preferably three in number. Each of the extensions 281 have a groove 282 to receive an elevated part 282 of the metal ring of the musical instrument. This allows the proximal ring to be force-fitted into position and to snap in and snap out of position according to the application of force or pressure.

Also, this embodiment does not require removing the existing metal ring, for example as does the embodiment depicted and described with respect to FIG. 23.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents but also equivalent structures.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

We claim:

1. An acoustical apparatus for engagement with at least one of a distal end and a proximal end of a musical wind instrument wherein the acoustical apparatus comprises:

at least one hollow housing member dimensioned to surround said at least one of said distal end and said proximal end of a musical wind instrument wherein each of said at least one hollow housing member is provided with a plurality of shoe elements, wherein said shoe elements engage a selected portion of a periphery of said at least one of said distal end and said proximal end of the musical wind instrument.

2. The apparatus as in claim 1, wherein at least one of the hollow housing members comprises an acoustical bell element selected from the group consisting of a generally cylindrical shaped acoustical bell element and a generally conical shaped acoustical bell element.

3. The apparatus as in claim 1, wherein two of the hollow housing members comprise a generally cylindrical acoustical ring element.

4. The apparatus as in claim 1, wherein said shoe elements comprise at least one inwardly projecting leg member and an inner contoured shoe member dimensioned to engage a portion of said musical wind instrument.

5. The apparatus of claim 4, wherein said shoe element comprises an outer handle member.

6. The apparatus as in claim 4, wherein said shoe elements comprise a pair of inwardly projecting leg members which are dimensioned to be slidably received in suitably dimensioned discrete apertures in said at least one hollow housing member.

7. The apparatus as in claim 1, wherein at least one of said at least one hollow housing member comprises a plurality of apertures.

8. The apparatus as in claim 7, wherein said at least one housing member comprises means to selectively cover said plurality of apertures.

9. The apparatus as in claim 1, wherein at least one of said at least one hollow housing member comprises a rigid continuous member.

10. The apparatus as in claim 1 wherein at least one of said at least one hollow housing member comprises a flexible split member.

11. The apparatus as in claim 1, wherein said shoe elements are biased inwardly by a single spring element.

12. The apparatus as in claim 1, wherein said shoe elements are biased inwardly by independent spring elements.

13. The apparatus as in claim 1, comprising a lifting mechanism for at least one of said shoe elements, wherein said lifting mechanism comprises:

a pin fixed to a plurality of posts attached to said at least one hollow housing member;

a rod pivotally mounted on said pin, said rod having a slot at one rod end for inserting into an outside portion of one of said shoe elements;

a key element attached to an opposite end of said rod;

a tension spring housed under said key element for exerting pressure on said key element.

14. The apparatus as in claim 1, wherein a distal end and a proximal end of at least one of said hollow housing members are provided with reinforced lips.

15. The apparatus as in claim 1, wherein said at least one hollow housing member has a generally uniform interior configuration.

16. The apparatus as in claim 1, wherein said at least one hollow housing member comprises an interior configuration comprising a notch dimensioned to receive an outwardly projecting portion of said musical instrument.

17. The apparatus as in claim 16, wherein said interior configuration comprises a plurality of inward extensions, each of said inward extensions comprising said notch for receiving an elevated part of a metal ring of said outwardly projecting portion of said musical instrument.

18. The apparatus as in claim 1, wherein each of said at least one hollow housing members comprise an opening formed in a distal end and a proximal end each of said at least one hollow housing member.

19. The apparatus as in claim 18, wherein an opening of the distal end and an opening of the proximal end are aligned generally parallel to one another.

20. The apparatus as in claim 18, wherein the distal end opening and the proximal end opening of said at least one housing member are disposed at an angle relative to one another.

21. The apparatus as in claim 1, wherein said at least one hollow housing member is permanently attached to said musical instrument.

22. The apparatus as in claim 1, wherein said shoe elements are fixed to said at least one hollow housing member.

23. The apparatus as in claim 1, wherein said at least one hollow housing member comprises a one-piece construction having a shape of one of a cylindrical shape and a conical shape, said construction being sufficiently flexible to change said shape to an elliptical shape when said at least one hollow housing member is squeezed to allow release of grip of said hollow housing member on said apparatus.

24. An acoustical apparatus for selective engagement with at least one of a distal end and a proximal end of a musical wind instrument wherein the acoustical apparatus comprises:

at least one hollow housing member dimensioned to surround one end of a musical wind instrument wherein the hollow housing member comprises a plurality of shoe elements, wherein said shoe elements engage a selected portion of the periphery of said one end of the musical instrument.

25. An acoustical apparatus for engagement with a distal end of a variety of musical wind instruments wherein the acoustical apparatus comprises:

at least one hollow housing member dimensioned to surround said distal end of a musical wind instrument wherein the hollow housing member comprises a plurality of shoe elements, wherein said shoe elements engage a selected portion of the periphery of the distal end of said musical instrument.

* * * * *